United States Patent [19]

Giller et al.

[11] 4,213,662

[45] Jul. 22, 1980

[54] TUNGSTEN/BROMINE CYCLE LAMP

[75] Inventors: Henricus F. J. I. Giller; Germain R. T'Jampens, both of Eindhoven, Netherlands

[73] Assignee: U.S. Philips Corporation, New York, N.Y.

[21] Appl. No.: 933,868

[22] Filed: Aug. 15, 1978

Related U.S. Application Data

[62] Division of Ser. No. 788,424, Apr. 18, 1978, Pat. No. 4,128,783.

[30] Foreign Application Priority Data

May 10, 1976 [NL] Netherlands ..... 7604953

[51] Int. Cl.[2] ..... H01J 9/38

[52] U.S. Cl. ..... 316/24; 316/20

[58] Field of Search ..... 316/24, 20; 313/222, 313/223

[56] References Cited

U.S. PATENT DOCUMENTS

| | | | |
|---|---|---|---|
| 3,712,701 | 1/1973 | Johnston | 316/24 X |
| 3,810,685 | 5/1974 | Coxon | 316/20 |
| 3,829,731 | 8/1974 | T'Jampens | 313/222 X |

*Primary Examiner*—William R. Briggs

*Attorney, Agent, or Firm*—Robert S. Smith

[57] ABSTRACT

A tungsten/bromine cycle lamp having a metal getter containing compounds of the formula $MeNH_xBr_{x+1}$, $TaBr_5C_5H_5N$ or the decompositions products thereof. These compounds can be accurately dosed. They present the advantage that getter and reactive gas can be introduced into the lamp in mutually matched quantities and in one operation.

4 Claims, 1 Drawing Figure

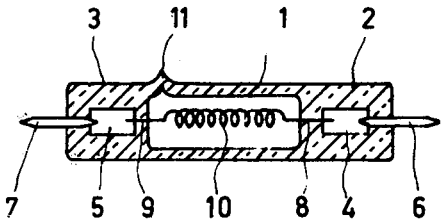
3
11
1
2
7
5
9
10
8
4
6

TUNGSTEN/BROMINE CYCLE LAMP

This is a division of application Ser. No. 788,424, filed Apr. 18, 1978, now U.S. Pat. No. 4,128,783.

The invention relates to a tungsten/bromine cycle lamp having a transparent lamp vessel in which a tungsten filament is arranged and in which a metal selected from the group consisting of Ti, Zr, Nb, Ta, V and Hf is present as a getter and a gas mixture containing inert gas, hydrogen and bromine.

Such lamps are disclosed in Netherlands pat. application No. 7,206,616 (PHN.6280). In these lamps the metal getter the object of which is to remove oxygen from the gas filling, is provided as a wire piece, foil or bead. In practice the getter is usually secured to a part of the filament or to the lamp vessel. This requires an extra operation in the manufacture of the lamp and the handling of a very small component, since only a small quantity of getter (approximately 100 $\mu$gr) is used.

In addition the known lamps must be provided with a measured quantity of bromine and hydrogen, Although the application states that the getter can be provided in the lamp as a metal bromide, the quantities of metal bromide and separately added hydrogen should nevertheless be matched to each other.

It is the object of the invention to provide a metal getter and a reactive gas with which the manufacture of such lamps is simplified.

Accordingly the invention relates to a tungsten/bromine cycle lamp of the kind mentioned in the preamble and is characterized in that the lamp contains a compound of the formula $MeNH_xBr_yC_z$ or decomposition products thereof, in which formula z has the value 0 or 5, in which, if z=0, Me is vanadium, niobium or tantalum, x=1,2 or 3 and y=x+1 or Me is titanium, zirconium or hafnium, x=1 or 2 and y=x+1, and in which, if z=5, Me is tantalum and x=y=5.

The compounds $MeNH_xBr_{x+1}$ decompose in an operating lamp into metal, nitrogen, bromine and hydrogenbromide, the compound $TaBr_5C_5H_5N$ into tantalum, hydrogenbromide, carbon and nitrogen. The compounds are, however, readily stable in air at room temperature. The preparation of the compound $TaNH_3Br_4$ is described in Izv. Akad.Nauk SSSR, Neorg. Mater. 3 (12) 2259 (1967). The other compounds of the formula $MeNH_xBr_{x+1}$ can be obtained in an analogous manner. The compound $TaBr_5C_5H_5N$ is described in Adv. Chem. Ser. 37 243 (1963).

The compounds are preferably introduced into the lamp as a dispersion in an organic solvent. The compound $TaBr_5C_5H_5N$ is soluble in polar solvents, for example pyridine. The remaining substances give suspensions. As a suspending agent are used, for example, hydrocarbons, for example benzene, toluene, and so on. From a point of view of lamp manufacture, $TaBr_5C_5H_5N$ is therefore to be preferred.

For lamps having a very high filament temperature, the compounds $MeNH_xBr_{x+1}$ may be preferred because in addition to hydrogenbromide they also supply free bromine, which may be desired in the said lamps.

The quantity of a compound which is introduced into a lamp is generally so large that the partial pressure of HBr in the lamp after decomposition of the compound is 2–20 Torr, measured at room temperature. As a rule, a partial pressure of HBr of 3–10 Torr is used.

The advantage of the lamps according to the invention is that both the quantity of getter and the quantity of HBr and of HBr and $Br_2$, respectively, in the lamp are accurately adjustable. The advantage of the manufacture of these lamps is that getter metal and reactive gas can be introduced into the lamp in one operation and furthermore that no mechanical operations are necessary to fix the getter in the lamp. Of course, mixtures of two or more of the said compounds may also be used.

The invention also relates to a method of manufacturing a tungsten/bromine cycle lamp having a transparent lamp vessel and a tungsten filament in which a compound containing bromine and Ti, Zr, Nb, Ta, V or Hf is introduced into the lamp vessel, the lamp vessel is filled with an inert gas and then sealed, characterized in that a dispersion of a compound of the formula $MeH_xBr_yC_z$ is introduced into the lamp and the solvent is then evaporated and expelled.

As an inert gas in the lamps is used a gas (mixture) which is useful for this purpose, for example nitrogen, argon, krypton.

The lamps may be used as motorcar lamps, projection lamps, photolamps, and the like.

An embodiment of the invention will be described in greater detail with reference to the Figures and the Examples.

The FIGURE shows a 12 V/55 W H1 motorcar lamp.

In the FIGURE a quartz glass lamp vessel 1 is sealed at either end by means of pinch seals (2 and 3) in which molybdenum foils (4 and 5) are incorporated. Connected to these are current conductors (6 and 7) and the supports (8 and 9) of the filament 10. At the end of the manufacturing process the lamp vessel is sealed at 11. The lamp vessel has a capacity of 0.27 $cm^3$, inside length 10 mm, width 6 mm.

EXAMPLES

1. Lamps as shown in FIG. 1 but with an exhaust tube at 11 were manufactured in the usual manner. A solution of $TaBr_5C_5H_5N$ in pyridine was introduced into the lamp in a quantity (5.7 $\mu$g) which after decomposition gives a partial pressure of HBr of 3 Torr at room temperature. The solvent was evaporated by evacuating the lamp vessel to a residual pressure of $10^{-3}$ Torr. Although it is usual to fill such lamps with inert gas to a pressure of 3.5 atm., only 1.5 atm. krypton were introduced into the lamps so as to be able to evaluate the operation of the gas filling and the getter in a shorter time. In order to test the gettering function, 1 Torr oxygen was also introduced into the lamp, after which the exhaust tube was sealed. The lamps were operated at 13.2 Volts, a filament temperature of 3200° K. being reached. After 200 hours in operation the lamps were still completely bright and no phenomena could be observed which indicated the presence of oxygen.

2. In an analogous manner lamps were manufactured with 7.8 $\mu$g of $TaNH_3Br_4$ which after decomposition of that material had a partial pressure of HBr of 3 Torr at room temperature. The results of operating tests were similar to those described in Example 1.

What is claimed is:

1. A method of manufacturing a tungsten/bromine cycle lamp which comprises: providing a transparent lamp vessel, providing a tungsten filament in said vessel, introducing a dispersion of a compound of the formula $MeH_xBr_yC_z$ into said vessel, in which formula z has the value 0, Me is vanadium, niobium or tantalum, x=1, 2 or 3 and y=x+1, evaporating and expelling the solvent of said dispersion from said vessel, filling said lamp vessel with an inert gas and sealing said lamp vessel.

2. A method of manufacturing a tungsten/bromine cycle lamp which comprises: providing a transparent lamp vessel, providing a tungsten filament in said vessel, introducing a dispersion of a compound of the formula $MeH_xBr_yC_z$ into said vessel, in which formula z has the value 0, Me is tantalum, zirconium or hafnium, $x=1$ or 2 and $y=x+1$, evaporating and expelling the solvent of said dispersion from said vessel, filling said lamp vessel with an inert gas and sealing said lamp vessel.

3. A method of manufacturing a tungsten/bromine cycle lamp which comprises: providing a transparent lamp vessel, providing a tungsten filament in said vessel, introducing a dispersion of a compound of the formula $MeH_xBr_yC_z$ into said vessel, in which formula $z=5$, Me is tantalum, $x=y=5$, and evaporating and expelling the solvent of said dispersion from said vessel, filling said lamp vessel with an inert gas and sealing said lamp vessel.

4. A method of manufacturing a tungsten/bromine cycle lamp which comprises: providing a transparent lamp vessel, providing a tungsten filament in said vessel, introducing a dispersion of a compound of the formula $TaBr_5C_5H_5N$ into said vessel, evaporating and expelling the solvent of said dispersion from said vessel, filling said lamp vessel with an inert gas and sealing said lamp vessel.

* * * * *

UNITED STATES PATENT OFFICE

CERTIFICATE OF CORRECTION

Patent No. 4,213,662 Dated July 22,1980

Inventor(s) HENRICUS F.J.I. GILLER et al

It is certified that error appears in the above-identified patent and that said Letters Patent are hereby corrected as shown below:

Under Related U.S. Application Data, item 62, change date to read -- April 18,1977 --

Signed and Sealed this

*Twenty-fourth* Day of *February 1981*

[SEAL]

*Attest:*

RENE D. TEGTMEYER

*Attesting Officer*

*Acting Commissioner of Patents and Trademarks*